US007389609B2

(12) United States Patent
Yorgason

(10) Patent No.: US 7,389,609 B2
(45) Date of Patent: Jun. 24, 2008

(54) LOUVER ROTATION APPARATUS AND METHOD

(76) Inventor: Kim Charles Yorgason, 151 Grulla Ct., Norco, CA (US) 92860

( * ) Notice: Subject to any disclaimer, the term of this patent is extended or adjusted under 35 U.S.C. 154(b) by 64 days.

(21) Appl. No.: 10/844,749

(22) Filed: May 12, 2004

(65) Prior Publication Data

US 2005/0252086 A1 Nov. 17, 2005

(51) Int. Cl.
*E06B 7/096* (2006.01)

(52) U.S. Cl. ..... 49/82.1; 49/87.1

(58) Field of Classification Search ..... 49/82.1, 49/73.1, 87.1, 74.1, 403; 452/221, 224
See application file for complete search history.

(56) References Cited

U.S. PATENT DOCUMENTS

| | | | | | |
|---|---|---|---|---|---|
| 2,272,722 | A | | 2/1942 | Morin | |
| 3,685,205 | A | | 8/1972 | Requena | |
| 3,758,988 | A | | 9/1973 | Tachikawa | |
| 3,847,210 | A | * | 11/1974 | Wells | 165/103 |
| 3,991,518 | A | | 11/1976 | Ishihara | |
| 4,435,920 | A | * | 3/1984 | Osaka et al. | 49/82.1 |
| 4,505,070 | A | * | 3/1985 | Clipp et al. | 49/82.1 |
| 5,029,413 | A | | 7/1991 | Jovanovic | |
| 5,216,837 | A | | 6/1993 | Cleaver et al. | |
| 5,419,082 | A | * | 5/1995 | Li | 49/82.1 |
| 5,469,658 | A | | 11/1995 | Digianni et al. | |
| 6,059,006 | A | | 5/2000 | Rossini | |
| 6,094,864 | A | | 8/2000 | Hsu | |
| 6,145,251 | A | | 11/2000 | Ricci | |
| 6,219,985 | B1 | * | 4/2001 | Hsu | 52/473 |
| 6,314,680 | B1 | | 11/2001 | Buckwalter et al. | |
| 6,568,131 | B1 | * | 5/2003 | Milano, Jr. | 49/82.1 |
| 6,854,211 | B1 | * | 2/2005 | Blachley | 49/82.1 |

* cited by examiner

*Primary Examiner*—Jerry Redman
(74) *Attorney, Agent, or Firm*—Donn K. Harms

(57) ABSTRACT

An louver rotation mechanism for use in rotating a louvered shutter having louvers rotationally engaged with a frame. The device features one or a plurality of gear modules which are positionable to a fixed location on one or a plurality of rack bars. The gear modules may be spaced on the rack bars to any number of positions wherein they will engage with louver gears from an array of louvers engaged with the frame. A high degree of customization is provided by allowing the use of the rack bars with any number of different sized louvers at different spacings in a frame by simply adjusting the positions of the rack modules for operative engagement with the louver gears.

9 Claims, 3 Drawing Sheets

LOUVER ROTATION APPARATUS AND METHOD

FIELD OF THE INVENTION

The herein disclosed invention relates to louvered devices. More particularly it relates to a device and method for control and rotation of rotationally mounted louvers positioned vertically in windows or horizontally over skylights and patios. The disclosed and described improved rack system features racks formed by one or a plurality of user positionable gear modules attachable to operative positions on a rack bar registered to engage louver gears connected to at least one end of one or a plurality of rotatable louvers. By employing gear modules adapted for cooperative engagement at a user designated fixed position, the device provides easy customization of any length of rack to rotationally operate any number of louvers of any number of widths. Further, since the gear modules are positioned only where needed to engage a louver, the rod itself can be thin and flexible thereby allowing rods which are extremely long and can also traverse a slight curve or bow in the frame holding it.

BACKGROUND OF THE INVENTION

Louvers are widely employed for control of the amount of light transmission through a given horizontal or vertical aperture and into a room through a window, or in the case of roof mounted louvers onto a deck or floor below. Adjustment of the total light transmission into a given area through a louver assembly is conventionally accomplished by concurrent synchronized rotation of each member of an assembly of louvers from a fully open position substantially perpendicular to the adjacent wall or roof surface to a closed position substantially parallel to the adjacent wall or roof surface. In the closed position louvers generally have a width allowing for overlap of the adjacent louvers to thereby minimize light transmission through the assembly. In cases where louvers are employed in horizontally disposed array such as over a patio, the louvers may also be used to inhibit the passage of rain or moisture through the exterior roof and onto the occupants and furnishings below.

Conventional louvers or window shutters are generally comprised of rectangular panels that are sized to cooperatively engage with the window frames around a window or other opening. Such panels generally are formed about their perimeter using two parallel side members known in the industry as stiles and two parallel end rails communicating with the stiles. Operationally engaged into the panels is a horizontal array of parallel louvers that can be rotated on axles or similar rotational attachments engaged with the stiles. The louvers are generally of a width to overlap when closed, and in the cases of window mounted assemblies the louver width must be such that the assembly is aesthetically pleasing and can vary from louvers less than 1 inch in width to louvers over 3 inches in width.

Adjustment of the rotational positioning of conventional non-gear driven louvers is accomplished by laterally translating an external tilt rod which attaches to one front edge of each louver to thereby vertically rotate the louvers in their engagement with the stiles. All louvers so attached to the rod will thus rotate to substantially the same angle in relation to the window when the rod is translated and thus regulate the light transmission into the room through the change in size of the gaps formed between the louvers.

Louvers rotated in this fashion are, however, easily rotated out of the desired position by gravity, vibration, or jarring, thus presenting a constant problem in the gaps therebetween becoming too large or too small to yield the desired light transmission into the room. The use of tilt rods also creates a visual obstruction in the center of each panel and obstructs in the cleaning of the louvers by blocking access thereto. The use of external tilt rods also does not work well with horizontally positioned louver assemblies since the rod itself inherently wants to close the assembly if it is positioned on its top and to open the assembly if positioned on the bottom.

Gear driven louver assemblies are known in prior art and provide an alternative to the tilt rod type of adjustment. However, many of the available gear driven devices require the use of rods which are inflexible for fear of binding and must have gears formed along the entire surface of the elongated rod which will exactly match and engage the specific gears on the louvers. No adjustability is provided to change both the tooth size and number and the positioning of the gears which rotate the louver gearing.

U.S. Pat. No. 6,094,864 (Hsu) attempts a solution to this problem by employing a pair of U-shaped columns which engage the ends of a plurality of louvers. Hsu, however, requires the use of a rod having gears of a fixed dimension and spacing formed about its entire surface increasing cost and limiting its use with louver gears that match the teeth on the rod.

U.S. Pat. No. 5,469,658 (Digianni) attempts to solve the problem inherent to rod rotated louvers by using an elongated gear formed on the entire surface of an operating rod. However, Digianni is still easily moved from proper adjustment by vibration or abrasion and requires the user to grab a louver to adjust the device increasing the likelihood of louvers getting dirty or damaged. Further, placing gear teeth on the entire rod surface increases the cost of the device. Also, the use of continuously geared rods increases the chance that gear engagement will be affected by expansion and contraction along the entire length of the rod. This risk is increased if the geared rod is formed of material different than that of the stile guiding it.

U.S. Pat. No. 2,272,722 (Morin) discloses a worm gear driven device for rotation of windows. As disclosed however, Morin is not easily constructed due to the need to align worm and communicating gears and also requires the use of yokes and other devices for use.

U.S. Pat. No. 6,314,680 (Buckwalter) teaches a gear driven internal system similar in operation to the above noted art. Buckwalter too requires specific gearing formed along the entire length of the rod driving the louver engaged gears increasing cost and limiting the user's flexibility to adjust gear sizing and positioning to the louver' gear size and positioning.

As such, there is a pressing need for a louver rotating system that provides for minimal gearing on the elongated rod which translates to rotate the louvers. Such a device should provide for easy location of gear modules in positions to register in engagement with the gears attached to rotatable louvers. Such a device should provide an easy means of attachment of the gear modules in the proper position and if need be provide for the attachment of gear modules of different gear sizes and in differing positions on the elongated rod to accommodate both a plurality of different width louvers and a plurality of different geared engagements between the gears on the louvers and the gear module. Still further such a device should be easily assembleable by the user and when used in a horizontal louver installation, provide for longer length rods which are of sufficient flexibility to translate over large roofs and coverings if need be.

Further, such a louver adjustment system should maintain the louvers in the user desired position and should not be easily affected by gravity, vibration, or jarring. Additionally, such a louver adjusting device should provide minimal potential of jamming from friction from the rod and stile or other rod engaging device which might occur using dissimilar materials with different expansion and contraction characteristics. Finally, such a louver adjusting system should be easy to adjust even in minute amounts to provide the optimum amount of light transmission through the gaps between the louvers for the user.

SUMMARY OF THE INVENTION

The above problems and others are overcome by the herein disclosed louver rotation system. Applicants's device, by employing an elongated rack bar having user mountable gear modules adapted for user positioning in registered engagement with the gears on louver ends, both decreases the cost of the rack bar and increases the utility by providing for both gear size adjustment and location adjustment. Since the rack bar translates internally in the frame surrounding one of the two ends of the rotationally mounted louvers, it will not obstruct the view through the louvers. Finally, the gear modules are easily positionable by the user to any of a plurality of equal or unequal spacings of adjacent gear modules to not only allow for varying width of louvers, since narrower louvers will be spaced closer in the frame and wider louvers further apart, but for infinite adjustments of the louver spacing and positioning which can be required in louvered devices of custom dimensions.

As herein described the disclosed device allows for rotation of louvers rotationally mounted within a frame or shutter panel, without the need or use of an exterior tilt rod. Instead, a knob or an electric motor rotationally communicate internally with at least one or a pair of translating rack bars having gear modules operatively engaged thereon. Rotation of the external knob or internally mounted motor thereby imparts louver rotation by translating one or a pair of rack bars which in turn rotate the geared louvers using the individually positioned gear modules.

Once rotated to the desired position, the louvers are maintained by in that position by the herein disclosed device through a number of design factors. First, the louvers all communicate with individual gear modules located on the rack bars. One or two rack bars may be employed with the current preferred mode using two in order that the weight of the two rack bars balance the force of each other. A worm gear which has its center axis parallel to the translation of a rack bar is rotated by the motor or knob or other means to impart rotation, and can provide a means to lock the rack bar from further transaction once the worm gear ceases rotation. This provides a means to hold the louvers in any position between fully open and fully closed. Alternatively, the worm gear may be incorporated at any point in a gear train that transits rotation between the louvers and an actuator.

The gear modules are positionable on the rack bar for a registered operational engagement with gears on the louvers and are held in position on the rack bar using means of attachment therefor such as clips, adhesive, frictionally engaging pins, or other means of engagement of the gear module to the rack bar. In this fashion the gear module spacing may be adjusted to accommodate different width louvers and extremely long and easy to translate rack bars may be assembled for larger vertical or horizontal louver assemblies.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing summary is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

Accordingly, it is the object of this invention claimed herein to provide a louvered shutter rotation system design which is easily operated and adjusted by the user.

It is another object of this invention to supply a louvered shutter rotation system that resists misadjustment through the use of balanced components.

It is still another object of this invention to supply a louvered shutter system that will maintain the louvers in the position set by the user.

It is a still further object of this invention to provide a louvered shutter rotation system which allows for the use of locatable gear modules on elongated adjustment rods.

A further object of this invention is the provision of gear module components that may be assembled and provide for modular assembly of shutters having different widths or spacings.

Yet a further object of this invention is the provision of gear module components attachable to translatable rods in a kit form allowing the user great utility in assembling elongated rods to rotate any number of different sized louvers.

These and further objectives of this invention will be brought out in the following part of the specification, wherein detailed description is for the purpose of fully disclosing the invention without placing limitations thereon.

BRIEF DESCRIPTION OF THE DRAWING FIGURES

The accompanying drawings which are incorporated in and form a part of this specification illustrate embodiments of the disclosed device and together with the description, serve to explain the principles of the invention.

DETAILED DESCRIPTION OF THE PREFERRED EMBODIMENTS OF THE DISCLOSED DEVICE

Figure 1:
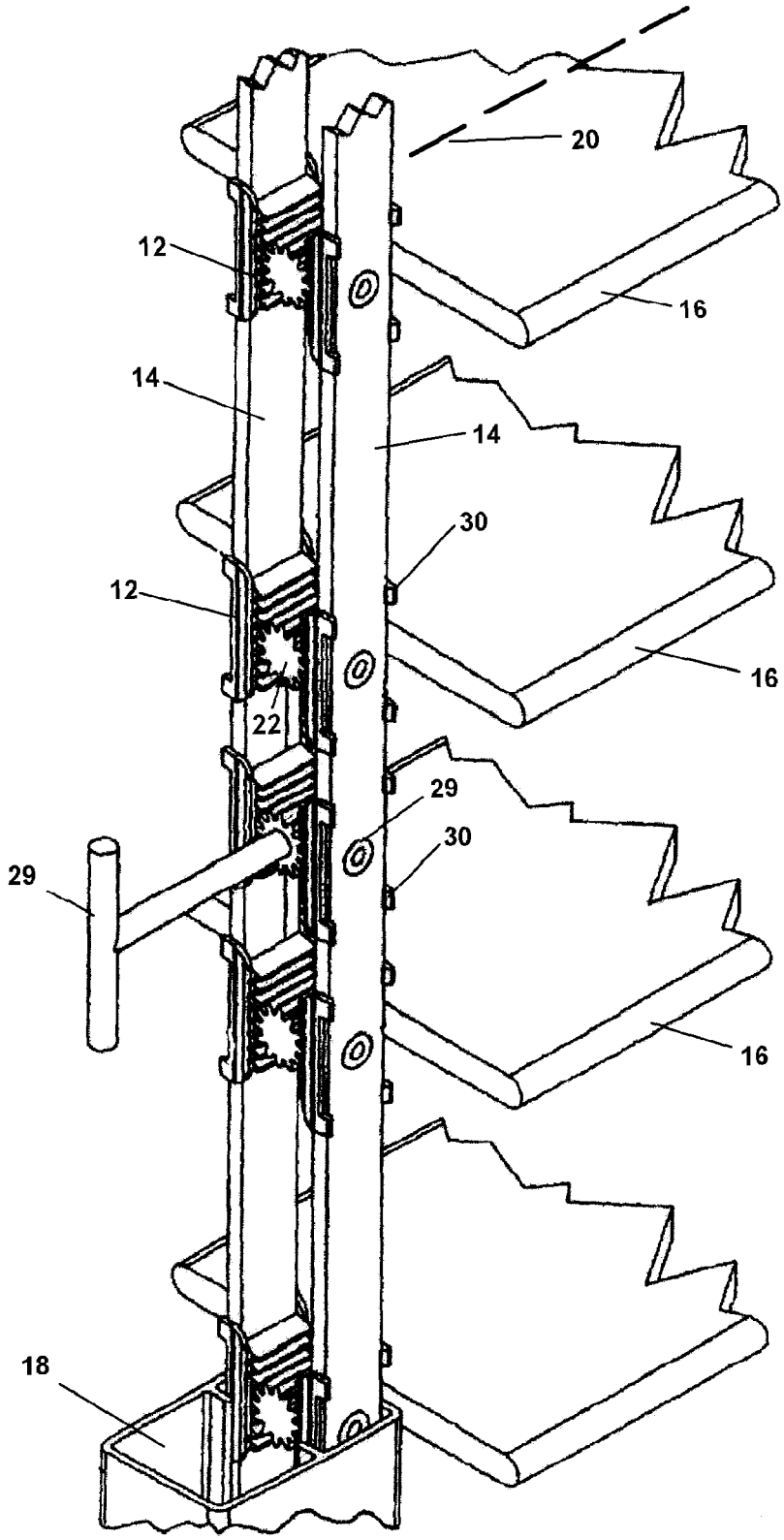
FIG. 1 depicts a perspective view of the herein disclosed louver rotation system employing positionable gear modules on elongated rack bars.

Referring now to FIGS. 1-4 which depict the current best modes and preferred embodiments of the device 10 for louver rotation. As shown, FIG. 1 depicts a perspective wherein independently positionable gear modules 12 are positioned on one or a plurality of elongated rack bars 14. Positioning of the gear modules 12 is determined by the spacing of the louvers 16 in their engagement with the frame 18 which conventionally surrounds at least both ends of the louvers 16. As noted above, louvers 16 are conventionally rotationally engaged at both ends into or through a frame 18 such that the louvers 16 will rotate in that engagement. The length of the louvers 16 is generally substantially equal and dictates the spacing of the two sidewalls forming the frame 18. The width of each louver 16 is also the same whereby the louvers may rotate from a closed position passing the least light between each parallel louver 16. In this closed position the louvers 16 generally overlap and as a consequence the spacing of the centerline 20 of each louver 16 is dictated by the amount of overlap desired and the width of each louver 16. Aesthetics plays a big part in louver 16 design from mini blinds which are less than an inch wide to plantation shutters that may be 3 inches or more.

The device 10 by employing independently positionable gear modules 12 provides for the use of inexpensive, lightweight, and easily translatably engaged rack bars 14. The rack bars 14 thus can be a common part of the system adaptable to any spacing of the louvers 16 in their frame 18 engagement by simply placing the appropriate gear module 12 in a fixed engagement on one side surface of the rack bar 14 such that it registerably engages with a respective louver gear 22 communicating directly or with an axle attached to the louver 16. This makes the device 10 highly adaptable to use with any width louver 16 at any spacing between the louvers 16 in their frame 18.

Instead of having to use expensive rack bars with gear teeth on the entire surface, the user can simply take the depicted flat rack bar 14 and place gear modules 12 at appropriate spacing from each other to engage the louver gears 22 operatively during use. Registering a plurality of gear modules 12 with their respective louver gear 22 is as simple as measuring points on the rack bar 14 and marking them and attaching gear modules 12 at the appropriate points whereby each gear module 12 will align with a louver gear 22 at a central point on the teeth 13 of the gear module. In this fashion it does not matter whether there are two louvers 16 or 100 louvers in an individual frame 18. The user can simply cut an appropriate length of rack bar 14 to the task and attach the appropriate number of gear modules 12 to the rack bar 14 to operatively engage with and rotate all of the individual louver gears 22 in the system. Further, by selecting an appropriate material from which to form the rack bar 14, excessive friction or wear from expansion or contraction relative to the stile can be avoided.

Rotation of the louvers 16 so engaged in a frame 18 is accomplished by a means to communicate lateral translation to one rack bar 14. As noted above, two rack bars 16 per system is preferred to provide a balance of weight to the system; however, those skilled in the art will realize that one rack bar 14 can be used to rotate all of the louvers 16 in a frame 18 and such is anticipated. Such a means to impart lateral translation to the rack bar 14 could be as simple as rotating one of the co-operatively engaged louvers 16 which would then translate one or both rack bars 14 from the rotation of the louver gear 22. Or, an exterior handle 24 may be engaged with a rotational mechanism to rotate a worm gear 26. The worm gear 26 has two functions in this arrangement in that rotation of the worm gear 26 will translate a co-operatively engaged gear module 12 and translate the rack bar 14 thereby rotating all of the louvers 16 similarly engaged with gear modules 12. Once rotation of the worm gear 26 ceases, the worm gear provides a means to prevent rotation of the spacing along the rack bar 14. Obviously a number of different sets of equidistantly spaced louver apertures 28 can be formed in any rack bar 14 thereby allowing the user to employ the same rack bar 14 for any number of different width louvers 16 in a system. The user simply places the gear modules 12 at appropriate spacing from each other for the intended louver 16 using the appropriate set of module apertures 12 formed on the rack bar 14. As is obvious, projections formed on the rack bar 14 which engage with apertures in the gear module 12 might also be used in a reverse type engagement and would work just as well and such is anticipated.

Alternatively, the rack bars 14 can be formed without the module apertures 28 and the user can simply measure points on the rack bar 14 at appropriate spacing for the intended louver width and spacing and attach the gear modules 12 at the appropriate points. Great utility is thus provided to the user as the simple rack bar can be engaged with modules at an infinite number of spacings to accommodate louvers 16 in an infinite number of widths and hence spacings with the frame 18.

It is important to provide a means of fixed positional engagement of the gear modules 12 with the rack bar 14. The gear modules 12 once properly positioned on the rack bar 14 to cooperatively rotationally engage with the respective louver louvers 16 since the teeth of the worm gear 26 prevent translation of the engaged gear module 12 unless the worm gear 26 is rotating. Using the disclosed design with positionable gear modules 12 the worm gear 26 may be incorporated into the device 10 at any point that is convenient by simply affixing a gear module 12 to engage the worm gear 26 at the chosen point.

Figure 2:
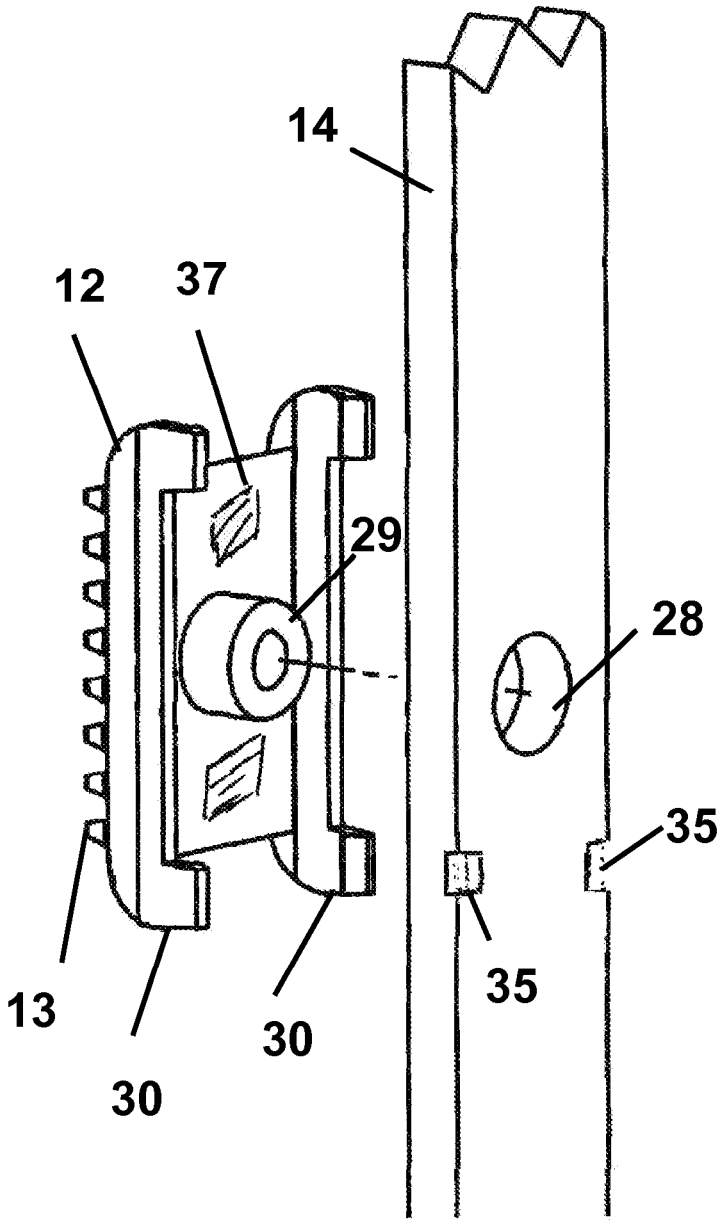
FIG. 2 shows a perspective view a gear module exploded from mounting on a rack bar.

FIG. 2 shows a perspective view of a gear module 12 and one means for registering the gear modules 12 in engagement with the rack bar 14 to engage a respective louver gear 12. Module apertures 28 may be formed in the surface of the rack bar 14 in advance and spaced at distances to place the gear module 12 in operative engagement with a projecting surface 29 from a respective louver gears 22. These module apertures 28 can either be detents in the surface of the rack bar 14 or communicate through the rack bar 14. Further, module apertures 28 can be placed at a plurality of spacings from each other so that each rack bar 14 can be used with a plurality of different widths of louvers 16. In the case of louvers 16 with a narrow width which will be spaced closer together, the module apertures 28 would be substantially equidistant from each other in a closed space relationship. For wider louvers 16 which will be spaced further apart when engaged with the frame 18, the louver apertures are formed substantially equidistant from each other at a wider gears 22 must stay in place during translation of the rack bar 14. FIG. 2 shows a frictional means of engagement of the gear module 12 to the rack bar 14 where flexible clips 30 having a beveled inner surface would allow the gear modules 12 to essentially snap onto the rack bar 14 and stay positioned using the compression of the clips 30 against the sides of the rack bars 14.

Another means of fixed engagement of the gear module 12 to the rack bar 14 would be through the engagement of the above-referenced projecting surface 29 formed on one of the gear module 12 or the rack bar 14 engaging with an aperture 28 formed on one of the gear module 12 or the rack bar 14 at appropriate spacings. The engagement would be held together by either the clips 30 or adhesive 34 or the frictional engagement of the projecting surface 29 with a slightly smaller aperture 28 or combinations of any of the above. Another means to fix the engagement of the gear modules 12 would be through the provision of notches 35 formed on the rack bar 14. As is obvious to those skilled in the art, other means for fixed positional engagement of the gear module 12 to the rack bar 14 at appropriate spacings could be used and such are anticipated; however, the current preferred mode employs one or a combination of the clips 30, the projection 29 engaged with an aperture 28, notches 35 engaging the clips 30, or adhesive 34.

Figure 3:
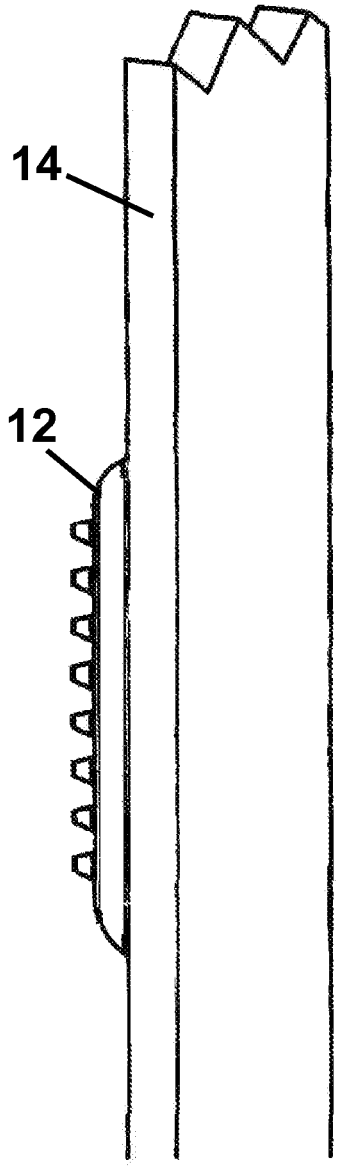
FIG. 3 depicts a rack bar wherein the gear module is formed into one side surface of the rack bar either by extrusion of the rack bar or other means.

FIG. 3 depicts a rack bar wherein the gear module 12 achieves its fixed engagement to the rack bar 14 employing a means to form the gear module 12 directly onto one side surface of the rack bar 14. This embodiment, while not as versatile in the field, would be easily employed using manufacturing techniques where the rack bar 14 is formed of plastic material as are the gear modules 12. The gear modules 12 could be heated with a dye into, or sonically welded onto, the side surface of the rack bar 14 or could be formed in an extrusion of the rack bar 14 in a sideways pattern and then cut to the appropriate width for the job at hand. In a mass production mode of many louver units, which is conventionally computer controlled, it would be easy to change the positioning of the formed gear modules 14 on the side surface of the rack bar 14 by changes in the input to the software controlling the process of where to form or place them.

Figure 4:
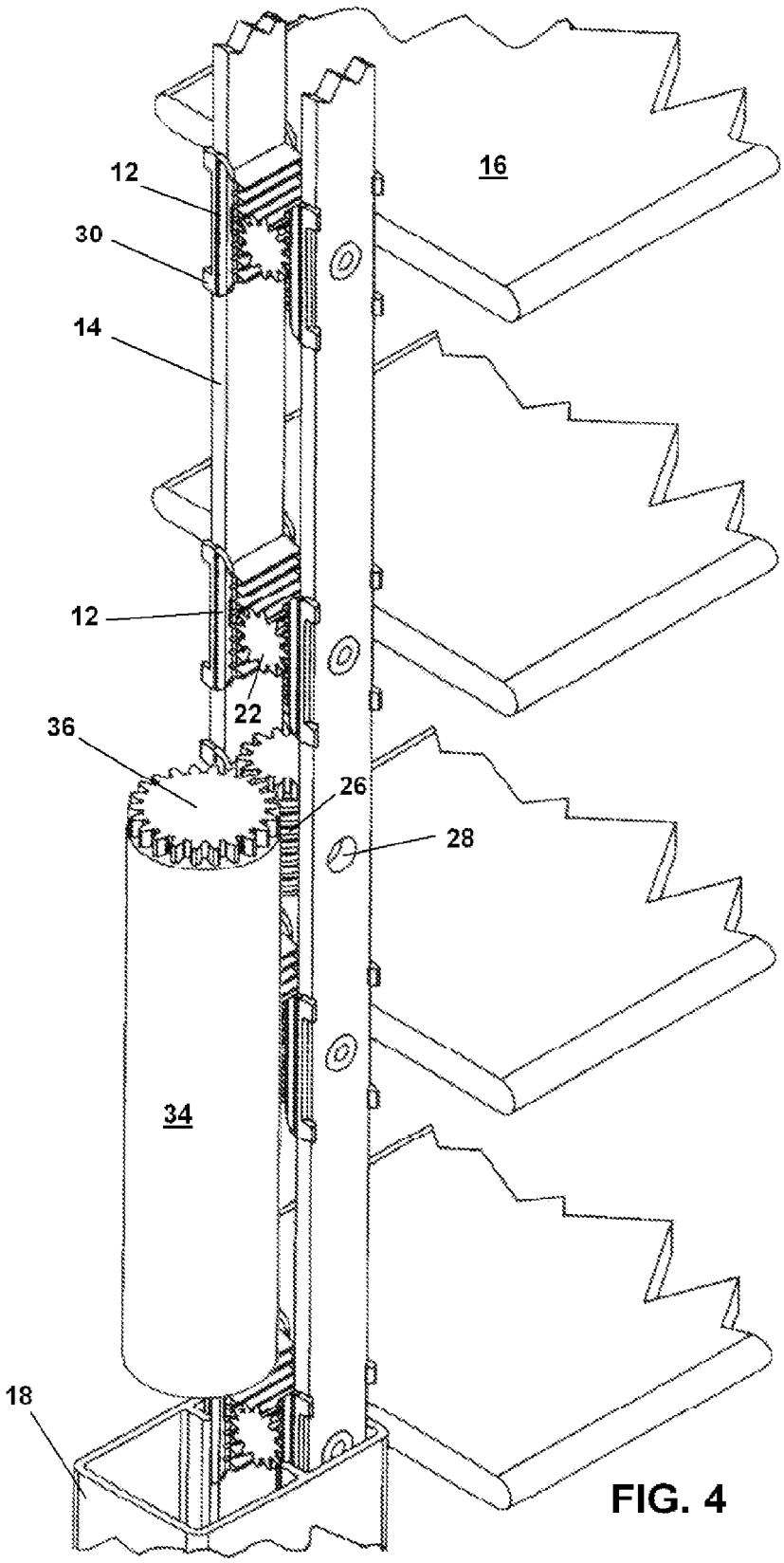
FIG. 4 depicts a perspective view showing dual rack bars with gear modules positioned for operative engagement with louver gears and employing a motor to communication rotation to the worm gear providing lateral translation to the rack bars.

FIG. 4 depicts a perspective view showing dual rack bars 14 with appropriately positioned gear modules 12 positioned for operative engagement with louver gears 22. Instead of a handle 24 or using one of the louvers 16 to rotate the other cooperatively rotatable louvers 16, a motor 34 with an appropriate motor gear 36 is employed to communicate rotation to the worm gear 26 providing lateral translation to the rack bars 14 in the above fashion. The use of such a motor 34 is accommodated in the generally small frame 18 holding the louvers 16 in rotational engagement by the smaller thickness and size of the rack bars 14. Using the motor 34 with a remote control (not shown) to initiate motion in forward or reverse would allow the user to adjust the louvers 16 to the desired position from a remote location. Since a separately locatable gear module 12 is used to engage with the worm gear 26, and this separate gear module 12 may be easily located anywhere on the length of the rack bar 14, it is much easier to place the motor 50 inside the frame 18 in a position to operate correctly. In fact, the motor might actually be placed in an endwall (not shown) of the frame 18 at the top or bottom of the louvers 16 rack bar 14 extended into the endwall where a separate gear module 12 would be attached to engage with the motor gear 36.

While all of the fundamental characteristics and features of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that any such substitutions, modifications, and variations may be made by those skilled in the art without departing from the spirit or scope of the invention. Consequently, all such modifications and variations are included within the scope of the invention as defined by the following claims.

What is claimed is:

1. A louver rotation apparatus comprising:

an elongated member adapted for translatable engagement with a frame;

said member having a first surface, a second surface opposite said first surface, and a side surface communicating therebetween;

a plurality of gear modules, each said gear module having a geared surface in a cooperative engagement with a respective louver gear engaged with an individual louver in a plurality of louvers; and means of attachment of each of said gear modules to said member at any individual attachment point along said member, each said attachment point registering said geared surface of said gear module in said cooperative engagement with a respective said louver gear, translation of said member, with said gear modules affixed at chosen said attachment points, imparting a rotation of all of said louver gears in a single direction thereby communicating a concurrent rotation in said direction to each said louver.

2. A louver rotation apparatus of claim 1 wherein said means of attachment of said gear module to said member at an attachment point comprises:

a plurality of opposing flexible clips projecting from each said gear module, said clips distanced to compressively engage said side surface of said member when positioned therebetween.

3. A louver rotation apparatus of claim 2 wherein said means of attachment of said plurality of said gear modules to said member at an attachment point further comprises:

a plurality of notches formed in the surface of said member, said notches positioned to engage with at least one flexible clip projecting from each of said gear modules; and each of said plurality of notches when engaged with at least one of said flexible clips of a respective gear module thereby positioning that gear module at its respective attachment point.

4. The louver rotation apparatus of claim 1 wherein said means of attachment of said gear module to said member at an attachment point comprises:

a projection extending from one of each of said respective gear modules or respective member; and each said projection dimensioned for cooperative fixed engagement with a respective aperture, said respective aperture formed on the other of each of said respective gear modules or said member.

5. The louver rotation apparatus of claim 1 wherein said means of attachment of said gear module to said member at said attachment point is adhesive.

6. The louver rotation apparatus of claim 1 additionally comprising:

a translation gear module engageable to said member at an engagement position;

means to translate said translation gear module thereby translating said member and rotating said louvers.

7. The louver rotation apparatus of claim 6 additionally comprising:

a worm gear rotationally engaged with said translation gear module substantially parallel to said member;

said means to translate said translation gear module being a means to rotate said worm gear; and whereby rotation of said worm gear translates said worm gear module and said attached member thereby rotating any louvers having said louver gears engaged with said gear modules.

8. The louver rotation apparatus of claim 7 wherein said means to rotate said worm gear is a handle adapted for rotational communication with worm gear.

9. The louver rotation apparatus of claim 7 wherein said means to rotate said worm gear is an electric motor adapted for rotational communication with worm gear.

* * * * *